US010323811B2

(12) United States Patent
Chien

(10) Patent No.: US 10,323,811 B2
(45) **Date of Patent: *Jun. 18, 2019**

(54) LED LIGHT HAS MORE THAN ONE REFLECTIVE MEANS TO PROJECT IMAGE

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 178 days.

This patent is subject to a terminal disclaimer.

(21) Appl. No.: 14/023,889

(22) Filed: Sep. 11, 2013

(65) Prior Publication Data

US 2015/0070936 A1 Mar. 12, 2015

(51) Int. Cl.

| | |
|---|---|
| ***F21K 99/00*** | (2016.01) |
| ***F21S 10/06*** | (2006.01) |
| ***F21S 10/02*** | (2006.01) |
| ***F21S 6/00*** | (2006.01) |
| ***F21V 21/14*** | (2006.01) |
| ***F21V 23/04*** | (2006.01) |
| *F21S 9/02* | (2006.01) |
| *F21Y 115/10* | (2016.01) |

(52) U.S. Cl.

CPC ..... *F21S 10/063* (2013.01); *F21S 6/002* (2013.01); *F21S 10/02* (2013.01); *F21S 10/023* (2013.01); *F21V 21/14* (2013.01); *F21V 23/0442* (2013.01); *F21S 9/02* (2013.01); *F21Y 2115/10* (2016.08)

(58) Field of Classification Search

CPC ..... F21K 9/50; F21S 10/02; F21V 21/14

See application file for complete search history.

(56) References Cited

U.S. PATENT DOCUMENTS

| | | | | |
|---|---|---|---|---|
| 2006/0152946 | A1* | 7/2006 | Chien | 362/641 |
| 2008/0304289 | A1* | 12/2008 | Chien | H04N 7/181 362/641 |
| 2010/0213879 | A1* | 8/2010 | Chien | 315/314 |
| 2010/0213880 | A1* | 8/2010 | Chien | G09F 9/33 315/317 |

* cited by examiner

*Primary Examiner* — Elmito Breval

(74) *Attorney, Agent, or Firm* — Bacon & Thomas, PLLC

(57) ABSTRACT

An LED and/or laser light device having a plug-in AC power source, an interchangeable power source, or a USB power source incorporates more than one optical-lens which having more than one reflective or refractive area or sections or surfaces, and at different positions, distances, and/or orientations relative to the LEDs and/or laser light source of the LED or laser light to cause light beams to reflect and/or refract before passing through the top optical-lens and create or project an image, message, time, geometric art, nature scene, galaxy, milky way, sky, cloud, starts, moon, water-wave, aurora light, animal, characters, cartoon, sign, logo, commercial to at least one surface surrounding and/or away-from the light device. The optical-lens may have a predetermined texture and/or shaped openings, windows, cutouts, or variable thicknesses and further may incorporate parts and accessories such as a motor to provide moving image effects with a wide viewing angle and variable colors or patterns.

11 Claims, 4 Drawing Sheets

Fig. 1
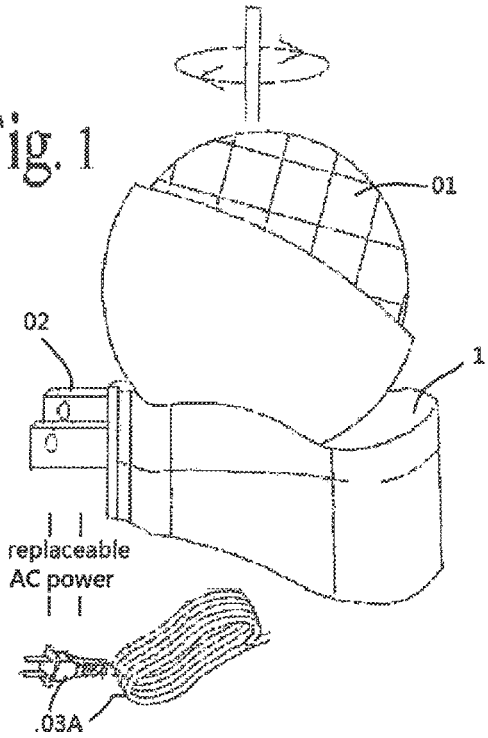
Fig. 1-1
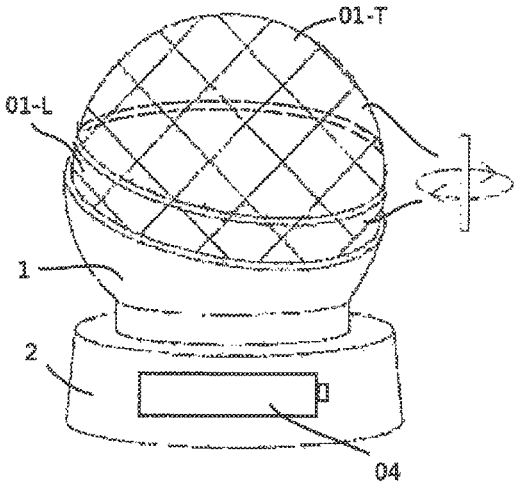
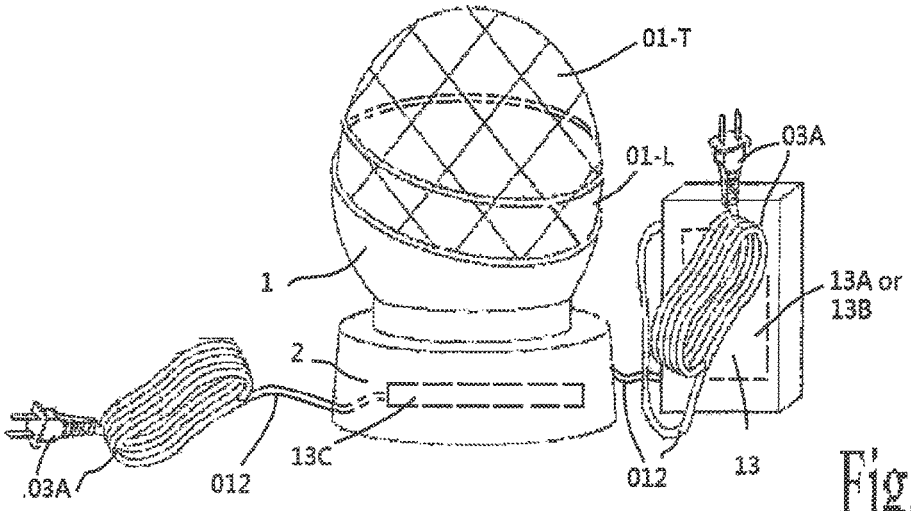
Fig. 1-2

Fig. 2
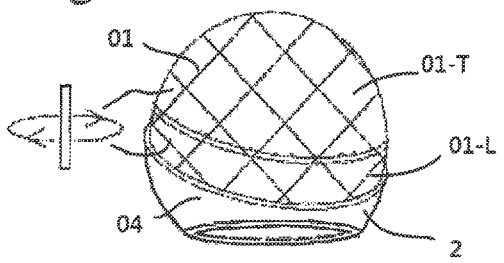
Fig. 2-1
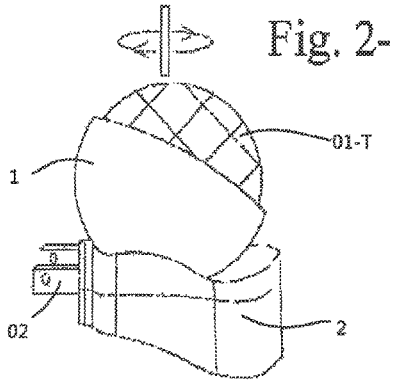
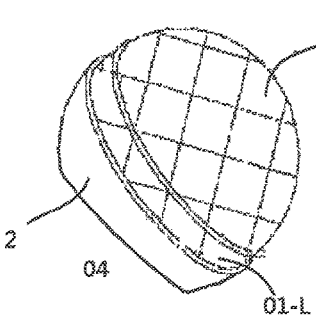
Fig. 2-2
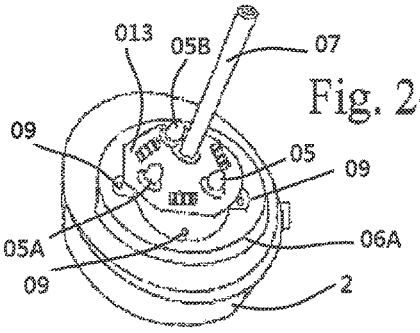
Fig. 2-3
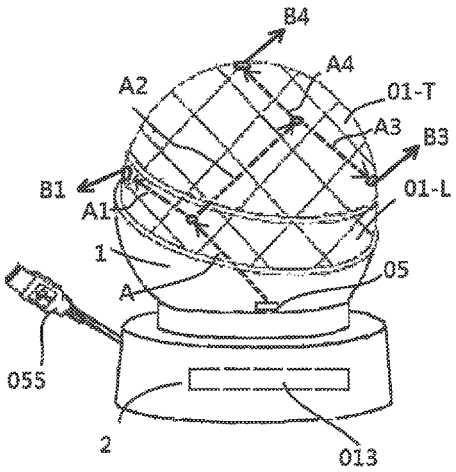
Fig. 2-5
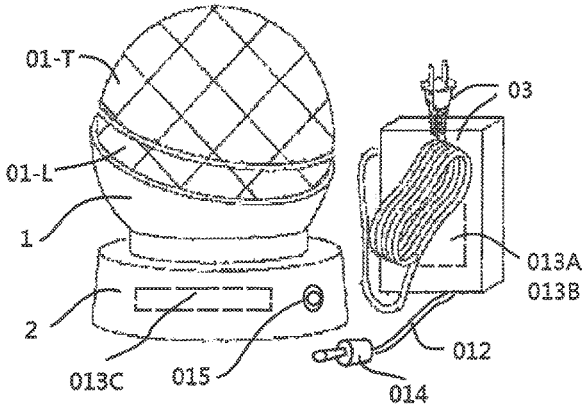
Fig. 2-4

Fig 4
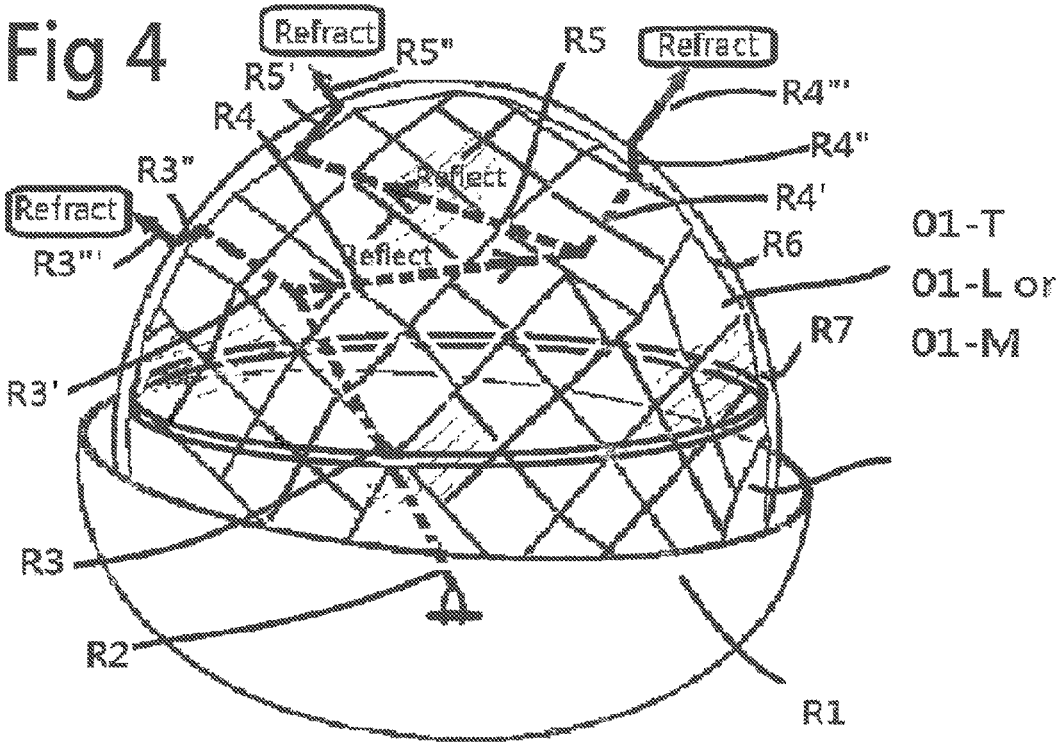
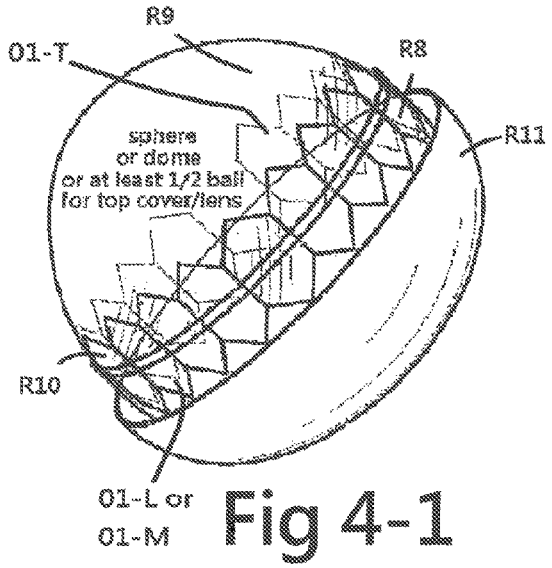
Fig 4-1
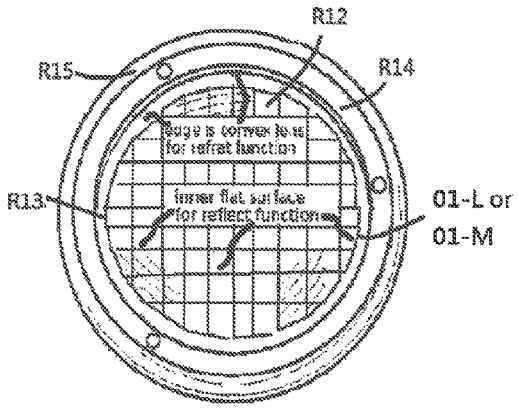
Fig 4-2

LED LIGHT HAS MORE THAN ONE REFLECTIVE MEANS TO PROJECT IMAGE

BACKGROUND OF THE INVENTION

A lot of bulky desk top devices having some optics means and noisy motor means to get images to the walls or ceiling are available in the marketplace. None of these devices have a compact size, light weight, or low cost.

According to one embodiment of the current invention, an image projector is provided for displaying a desired image, message, time, geometric art, nature scene, galaxy, milky way, sky, cloud, stars, moon, water-wave, aurora light, animal, characters, cartoon, sign, logo, or commercial on a desired surface and which has a compact size with light weight to allow people to achieve plug-in installation to any outlet device, such as a wall outlet, extension cord, power strip, outlet device.

A plug-in outlet or USB port allows easy connection with a power source without the disadvantages of an AC wired connection, an adaptor with a wired connection, or a transformer with a wire device, in which the wires are very difficult to handle and may cause people to fall down or be touched.

In addition, the plug-in outlet or USB port serves as an unlimited power source, unlike market-available models which are battery operated for desk top applications and which as a result require frequent change of battery to supply enough electricity for a plurality of LEDs, which may need hundreds of milliamps of current to per hour.

Consequently, the current invention, which is arranged to be plugged into outlets or USB ports, represents a big improvement over market-available desk top LED or laser light devices with wired connections or battery units. It is still possible to include a motor, rotating means, or magnet and magnetic-coil to provide moving effects, but in that case it may be necessary to use a wired power source, which will cause the consumer to fall down and is too risky for desk top installation, so it is preferred use direct plug-in to an outlet or a USB means with no wires.

According to a third preferred embodiment, the current invention may use an alternative design to create moving effects without the need to use a motor, or rotating magnetic and magnetic-coil means, in order to reduce costs, i.e., the LED does not use any motor means to create the changeable image, message, time, geometric art, nature scene, galaxy, milky way, sky, cloud, stars, moon, water waves, animal, characters, cartoon, sign, logo, commercial.

According to a fourth preferred embodiment, a big improvement provided by the current invention is to have all moving or motion effects made by a plurality of LEDs' sequential flashing, fade-in and fade-out, color changing, sequential, random, or other LED light performances or effects by turning individual LEDs on and off with a time difference, duration, or duty cycle and cause the resulting image to appear as if it were moving.

According to a fifth preferred embodiment, a more advanced improvement is to generate a shaped image, message, time, geometric art, nature scene, galaxy, milky way, sky, cloud, stars, moon, water-wave, aurora light, animal, characters, cartoon, sign, logo, or commercial from at least one or more optics means having a preferred texture, opening, cutouts, holes, or shape and a steady LED light beam with rotating or non-rotating means. The preferred embodiments of the current invention may utilize features disclosed in the inventor's copending U.S. patent application Ser. No. 14/023,889, filed Sep. 11, 2013; Ser. No. 14/323, 318; filed on Jun. 26, 2014 and Ser. No. 12/938,564, filed Nov. 2, 2014; and U.S. Pat. No. 7,455,444 (more than one LED light source); U.S. Pat. No. 7,632,004 (more than one optic means); and U.S. Pat. No. 8,277,087 (more than one reflective means to create multiple visible image).

The current has subject matter in common with the inventor's following copending applications: U.S. patent application Ser. No. 14/024,229 (LED light has kaleidoscope means); Ser. No. 13/021,124 (LED light having changeable image and pattern by kaleidoscope means to project to surfaces); Ser. No. 12/710,918 (LED light having more than one reflector means), now U.S. Pat. No. 8,277,087, the arrangement of which may be utilized in the current by providing a kaleidoscope means having more than one reflective means that uses a mirror or mirror-like means assembled into the kaleidoscope means; Ser. No. 11/806,284 (LED light having more than one optic means), now U.S. Pat. No. 7,632,004, which discloses an arrangement that may be utilized by the current invention by applying the more than one optics means in front of or in back of back of a kaleidoscope means to create, adjust, magnify, reduce, or enlarge an image, LED light beams, or an LED lights' shape, the optics means including any combination of an optics lens, optics mirror, laser hologram, laser grating film, or optics assembly.

The inventor's U.S. Pat. No. 7,455,444 discloses an LED light having more than one LED light source, the current invention also capable of utilizing more than one LED in a matrix arrangement with circuit means, IC means, sensor means, switch means, brightness control means, color mixing means, color selection means, color freeze means, motor means, gear means, and turn-on/turn-off means to cause a certain number of LEDs to be turned-on with desired colors, brightness, light brightness output, light functions, matrix combinations, motor means, rotating means, and/or gear set means to cause light to pass through the kaleidoscope means and optics means to achieve desired light patterns.

Other U.S. patent applications of the inventor include U.S. patent application Ser. Nos. 12/948,953; 12/938,564; 12/886,832; 12/876,507 [12/771,003; 12/624,621; 12/914,584; 12/318,471; 12/318,470; and Ser. No. 12/834,435; 12/292,153 (now U.S. Pat. No. 7,871,192); Ser. No. 12/232,505 (now U.S. Pat. No. 7,832,917); and Ser. No. 12/318,473 (now U.S. Pat. No. 7,832,918), Additional patent applications of the inventor that disclose projection lights include U.S. patent application Ser. No. 12/624,621 (now U.S. Pat. No. 8,303,150); Ser. No. 12/771,003 (now U.S. Pat. No. 8,408,736); Ser. No. 12/876,507 (now U.S. Pat. No. 8,083,377); Ser. No. 12/886,832; 12/938,564; 12/948,953; and Ser. No. 13/021,107.

Furthermore the inventor also has copending U.S. patent applications for light devices having interchangeable power sources for AC wall outlets and DC energy storage means, including all kinds of combinations selected from prong means, extension cords, adaptors, transformers, solar or wind power, batteries, chemical power, and biological power, all of which can be interchanged to provide AC or battery power in any desk top or plug in type projection light device having a built-in kaleidoscope means. The inventor's interchangeable power source applications U.S. patent application Ser. Nos. 12/318,473 and 12/940,255 (now U.S. Pat. No. 8,231,246).

The current invention thus may utilizes principles and structures from a variety of the inventor's patents or copending patent applications, such as: (1) a projection light device; (2) more than 1 optics means; (3) more than 1 LED; (4) more than 1 reflective means; (5) interchangeable power sources;

(6) laser means; (7) adjustable focus and position changing; and (8) use of a motor and gear set for image adjustment and moving.

This application also has subject matter in common with U.S. patent application Ser. Nos. 12/710,561; 12/711,456; 12/771,003; 12/624,621; 12/622,100; 12/318,471; 12/318,470; 12/318,473; 12/292,153; 12/232,505; 12/232,035; 12/149,963; 12/149,964; 12/073,095; 12/073,889; 12/007,076; 12/003,691; 12/003,809; 11/806,711; 11/806,285; 11/806,284; 11/566,322; 11/527,628; 11,527,629; 11/498,874; 12/545,992; 12/806,711; 12/806,285; 12/806,284; 12/566,322; 12/527,628; 12/527,629; 12/527,631; 12/502,661; 11/498,881; 11/255,981; 11/184,771; 11/152,063; 11/094,215; 11/092,742; 11/092,741; 11/094,156. 11/094,155. 10/954,189; 10/902,123, 10/883,719; 10/883,747; 10/341,519; 12/545,992; and 12/292,580.

In particular, the following applications show light devices that have at least some features in common with included or optional features of the LED light device of the present invention: Ser. No. 12/710,561 ("LED power failure Light"); Ser. No. 12/711,456 ("LED light device has special effects"); Ser. No. 12/771,003 ("LED light device has more than 1 reflective means for plurality of image"); Ser. No. 12/624,621 ("projection device or assembly for variety of LED light"); Ser. No. 12/622,000 ("Interchangeable Universal Kits for all LED light"); Ser. No. 12/318,471 ("LED night light with pinhole imaging"); Ser. No. 12/318,470 ("LED night light with Projection features"); Ser. No. 12/318,473 ("LED night light with laser or hologram element"); Ser. No. 12/292,153 ("LED night light with Projection or imaging features"); Ser. No. 12/232,505 ("LED night light with Projection features"); Ser. No. 12/149,963 ("Removable LED light device"); Ser. No. 12/149,964 ("Surface Mounted Device with LED light"); Ser. No. 12/073,095 ("LED Track light device"); Ser. No. 12/073,889 ("LED light with changeable position with Preferable power source"); Ser. No. 12/007,076 ("LED light with changeable geometric system"); Ser. No. 12/003,691 ("LED light with changeable geometric dimension features"); Ser. No. 12/003,809 ("LED light with changeable features"); Ser. No. 11/806,711 ("Multiple LED light with adjustable angle features"); Ser. No. 11/806,285 ("LED Night light with outlet device"); Ser. No. 11/806,284 ("LED Night light with more than 1 optics means"); Ser. No. 11/527,628 ("Multiple function Night light with air freshener"); Ser. No. 11/527,629 ("LED Night light with interchangeable display unit"); Ser. No. 11/498,874 ("Area illumination Night light"); Ser. No. 11/527,631 ("LED Time piece night light"); Ser. No. 12/545,992 ("LED time piece Night light"); Ser. No. 12/292,580 ("LED Time Piece Night light"); Ser. No. 11/498,881 ("Poly Night light"); Ser. No. 11/255,981 ("Multiple light source Night Light"); Ser. No. 11/184,771 ("Light Device with EL elements"); Ser. No. 11/152,063 ("Outlet adaptor with EL"); Ser. No. 11/094,215 ("LED night light with liquid medium"); Ser. No. 11/094,215 ("LED Night light with Liquid optics medium"); Ser. No. 11/092,741 ("Night light with fiber optics"); Ser. No. 10/883,747 ("Fiber Optic light kits for footwear"); Ser. No. 11/498,874 ("Area Illumination for LED night light"); Ser. No. 11/527,629 ("Time Piece with LED night light"); Ser. No. 11/527,628 ("Multiple Function Night light with Air Freshener"); Ser. No. 11/806,284 ("LED Night light with more than one optics mediums"); Ser. No. 11/806,285 ("LED Night Light with multiple function"); and Ser. No. 11/806,711 ("Multiple LEDs Light with adjustable angle function").

The applications of the inventor in general all apply physics or optics theory to a night light supplied with power from an outlet, battery, solar, or other power source. The present invention uses the physics or optics theory to create a plurality of LED light images on a surface. More specifically, the current invention uses more than one reflective means to transform a single LED spot light into a plurality of images on a surface to be seen by viewer. The principles of the invention may be applied to night lights of various types, including night lights disclosed in the above-listed patents and patent applications of the inventor, which may be powered by a variety of power sources, such as an outlet, batteries, solar, wind, or chemical power sources.

Because of the persistence of vision effect, caused by the human eye response time of more than 1/24 (41,67) to 1/16 (0.0625) seconds, when an object moves faster than the human eye response time, the last image will stay in the human eye and brain for an extended period of time. This theory can utilized to save power by causing an LED or LEDs to flash with a very short on-time of around 10 msec or less. This principle is similar to that of a motion picture in which, if an object in front of human eye is displayed in 16-24 pictures per second, people will think all pictures are continuous. Hence, the current invention uses a related circuit, control means, IC, and/or micro controller to cause an LED light device to blink at a rate that is much faster than 16-24 times (cycles) per second, with the LED or LEDs being turned on for 10% of each cycle and off for 90% of the cycle to save up to 90% of power consumption or increase battery life by nine times more than the full steady-ON condition. This is a significant power saving for all battery power source applications. It will be appreciated that new LEDs may be coming soon to enable the LEDs to have an even quicker response time of less than 10 msec, and possibly less than 5 msec or 2 msec, to provide even greater power saving. such adjustment of the duration of each cycle's turn-on and turn-off duration time will cause even more power saving to meet the green world concept. This is one of the very important concepts of the current invention.

Further cost saving can be achieved in the case of a battery powered unit by using a circuit with proper electric components, parts, and accessories to raise the voltage output of the batteries to trigger the LED or LEDs even though the number of batteries is less than that normally required to generate the required voltage. This can counter the tendency of people to use a large quantity of batteries and save substantial cost, which is another important advantage of the current invention.

A preferred embodiment of the current invention includes an LED night light with more than one reflective means within the geometrically shaped optics means to enable a plurality of LED light beams to pass through, reflect.

The LED night light includes at least one LED arranged inside a partially transparent geometric optics means having more than one reflective means, and at least one second reflective means within the geometric optics means which can reflect an LED light beams from its surface to the first or other reflective surfaces back and forth so that some LED light beams are reflected and travel within the optics means and other LED light beams pass through a partially transparent optics means to the outside.

In this embodiment, a plurality of the LED beams can project outside through a surface(s). Furthermore, at least one of the reflective means may be partially transparent so that a plurality of light beams pass through from the surfaces thereof, while another plurality of LED light beams is reflected retro-reflected within another reflector means and passes through some other surface(s).

The LED or LEDs of this embodiment are preferably connected with circuit means, power means, contact means, conductive means, switch means, sensor means, motor means, spin means, rotating means, gear set means, speed control means, printed circuit means, integrated circuit (I.C.) means and/or related parts and accessories to cause the LED or LEDs to turn on and off according to a predetermined time period, functions, colors, and/or effects to provide a desired lighting performance.

In the above-described preferred embodiment, the reflective means may be a mirror, chrome finished piece, polished piece, double-sided mirror, or any surface having reflective properties that permits light beams to pass through both optical elements of the current invention.

The partially transparent or see-though properties can be provided by a transparent piece, colored transparent piece, or any other piece that allows light beams to pass therethrough. A power source of this embodiment can be in the form of an outlet, batteries, solar power, chemical power, or wind power.

The LED or LEDs can be selected from any combination of single color, multiple color, multiple piece, standard, and special LED assemblies. The LEDs can be any number from 1 to N (N can be any number) arranged in a desired matrix or spacing.

Finally, the distance, position, and/or orientation of the reflective means may be changed based on the selected geometric shape of the optics means. The LED arrangement for different LED numbers, positions, colors, IC chip, control means, circuit means, functions, and brightness to create a desired plurality of light patterns, shows, color changing, image changing, or moving effects to be seen by people on surrounding surfaces including walls, a ceiling, a floor, or any other desired surface(s).

The geometric optics means can have any shape with multiple constructions and combination of elements selected from a light transmitting lens, reflective lens, convex lens, concave lens, laser lens, and hologram lens on an inner or outside surface or on all sides to provide desired light effects.

According to another preferred embodiment of the invention, an LED light device having power saving features includes at least one LED or LEDs for a light source, at least one housing having space to install circuit means, conductive means, electric components parts and accessories, switch means, sensor means, an integrated circuit (IC), and/or a micro controller to connect with a conventional market-available power source to cause the LED or LEDs to turn on and turn to provide predetermined functions or effects, with a predetermined duty cycle, color, and/or brightness.

The power-saving features are obtained by using the control means to cause the LED or LEDs turn-on for only a certain percentage of each cycle. In particular, the turn on time is selected to meet the persistence of vision of the human eye, so as to take advantage of the human eye's response time of 1/24 to 1/16 second so that the blinking LED or LEDs looks as if it were continuously on.

According to yet another embodiment of the invention, an LED light device having cost saving features includes at least one LED or LEDs as a light source, at least one housing having space to install circuit means, conductive means, electric components parts and accessories, switch means, sensor means, an integrated circuit (IC), and/or a micro controller to connect with a conventional market-available power source, preferably batteries, to cause the LED or LEDs to turn on and turn off according to a predetermined function or effects, duty cycle, color, and/or brightness.

In this embodiment, cost saving is obtained by providing batteries having a total voltage that is less than the LED trigger voltage and by providing electric components and related parts and accessories to increase the voltage output of the batteries to greater than the LED trigger voltage.

As noted above, the current invention uses geometrically shaped optics-means having built-in more than one reflective or refraction means to create a plurality of LED light beams that pass through or are reflected or retro-reflected by the more than one. The relative distance, position, and/or orientation of the more than one reflective means (and optional additional) reflective means will result in different light beam performance. This is a very low cost and simple way to make a splendid and eye catching light projection unit for people, and which may incorporate any desired power source such as a battery, USB power, outlet power, generator power, chemical power, solar power, wind power or another equivalent power source from the marketplace.

BRIEF DESCRIPTION OF THE DRAWINGS

FIGS. 1, 2, and 2-1 shows a first preferred embodiment of the current invention having prong with plenty of reflective section or areas or parts inside a geometric optics-piece and plenty of convex-lens to cause a plurality of light beams to be emitted out and project images to be seen by a viewer.

FIGS. 1-1, 1-2, and 2-4 show a first preferred embodiment of the current invention having an AC power-connector with plenty of reflective sections or areas or parts inside the geometric optics-piece and plenty of convex-lens to cause a plurality of light beams to be emitted out and project the images to be seen by a viewer.

FIGS. 2-2 and 2-5 show a variation of the first preferred embodiment of the current invention having a DC power source, or USB power source, or an interchangeable power source with plenty of reflective sections or areas or parts inside the geometric optics-piece and plenty of convex-lens to cause a plurality of light beams to be emitted out to project the images to be seen by a viewer. FIG. 2-5 shows one of the splendid light images created by the current invention in a yellow color image.

FIGS. 3 and 3-1 show a preferred construction for an LED light having more than one reflection or refraction piece(s) and a motor and circuitry and axis to install optic-piece(s).

FIGS. 4, 4-1, and 4-2 show an arrangement in which light beams are emitted to a first reflective and/or refraction piece and then hit second, third, and fourth reflective and/or refraction piece within a ball housing or cover, the reflective and/or refraction piece each having a convex exterior shape so that it acts as a convex-lens to allow a light beam to be emitted out and allow a projected image to be seen. FIG. 4 shows that different reflective and/or refraction piece can be situated at different distances, positions, and orientations relative to each other.

From Fig (FIG. 4-1) The preferred LED projection light application is for outdoor light has the top optic-lens (01-T) cover is a diamond-cut treated optic-lens has LED light source (R2) emit light-beam (R3) to inner flat reflective-area to split into (R3') and reflected light beam (R3') to hit the inner other points or area or segments or parts, and the said reflected light-beam pass through the wall material and deviate basing on the refractive physical theory as light beam (R3") to become refracted light-beam (R3'") came out from the outside surface. The light beam from LED (R3)→reflected→(R3')→refracted→(R3")→refracted→

(R3''') this is one of the LED light traveling-path for preferred embodiment which has lower optic-lens (01-L) and top optics-lens (01-L). The LED light-beam (R3) reflected into not only have (R3') but also have the $2^{nd}$ reflected light-beam (R4)→Reflected→(R5)→refracted→(R5')→refracted→R5''. Also, at the same time has the light-beam (R4) also not only reflected into (R5) but also have light-beam (R4')→refracted→(R4')→refracted→(R4'')→refracted→(R4'''). The LED single light-beam can has plurality of light-beam been reflected and/or refracted within the lower and/or top optics-lens at same time and incorporate with motor (06) and/or gear-set (06') to make the preferred top or lower optics-lens to rotating will make more splendid lighted pattern or image for moving effects.

So the diamond-cut optic-lens for outdoor light front cover to incorporated with inner $1^{st}$ optics-lens such as rotating prism-lens can created splendid light performance. Furthermore, while change the LED color from 1 color to 2 color or more colors and IC control so can make the more assortments light performance outdoor lighting.

From Fig (FIG. 4-2) show how to make the diamond-cut construction or other treatment for optic-lens (01-T) or optic-cover more than ½ ball. The top optic-lens (01-T) cover has one ½ half ball (R9) for top and add or assembled with lower partial of ball preferred optics-treatment optics-lens (01-L) so can make the top cover or top optics-lens (01) has more than ½ ball size. The reason to make more than ½ ball because we need to make much bigger size and more eye-exciting lighted image and/or pattern. The distance from the top cover or top optics-lens (01-T) to the lower (01-L) or inner $1^{st}$ optic-lens has related the best distance which is more than ½ ball because more distance can created more spread-out and more clear image and/or lighted patterns.

Figure 3:
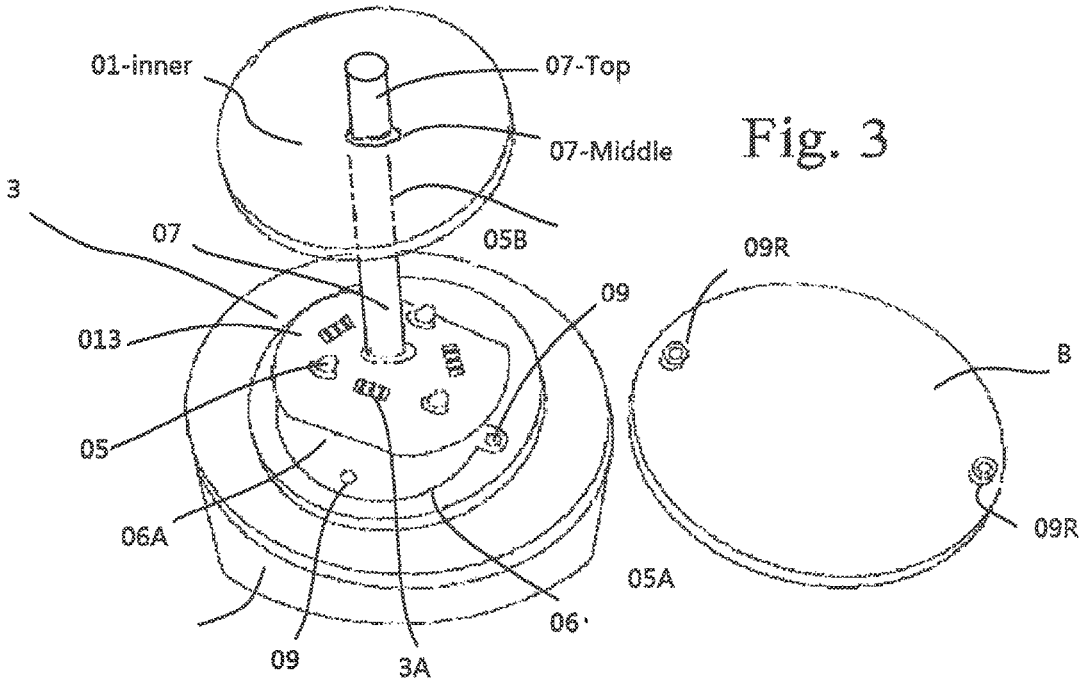

From FIG. 4-3) show the top (01-T) or lower (01-L) or inner (01-M) construction of the optic-lens which is diamond-cut optic-lens. The inner surface have a lot of flat surface (R12) which has high polished treated so can easily reflect all input light-beam and reflect to other direction depend on the input-angle of light-beam from LED(s). The one of diamond-cut optic-lens is the preferred for top (01-T) and/or lower (01-L) sphere $2^{nd}$ optic-lens outside is ball type so the outside is round and inner is flat surface so it become the convex lens (R13) so the $2^{nd}$ optic-lens for diamond-cut which also has plurality of the tiny convex-lens which offer the refractive optic-properties. This embodiment clear explain the diamond-cut $2^{nd}$ Top (01-T) optics-lens has both refractive and/or reflective optics properties in one top cover or top-lens to make the lower (01-L) or inner $1^{st}$ optic-lens came out light-beam to make more refraction and-or reflection to get splendid light effects.

DETAILED DESCRIPTION OF THE PREFERRED EMBODIMENTS

Figures 1, 3:
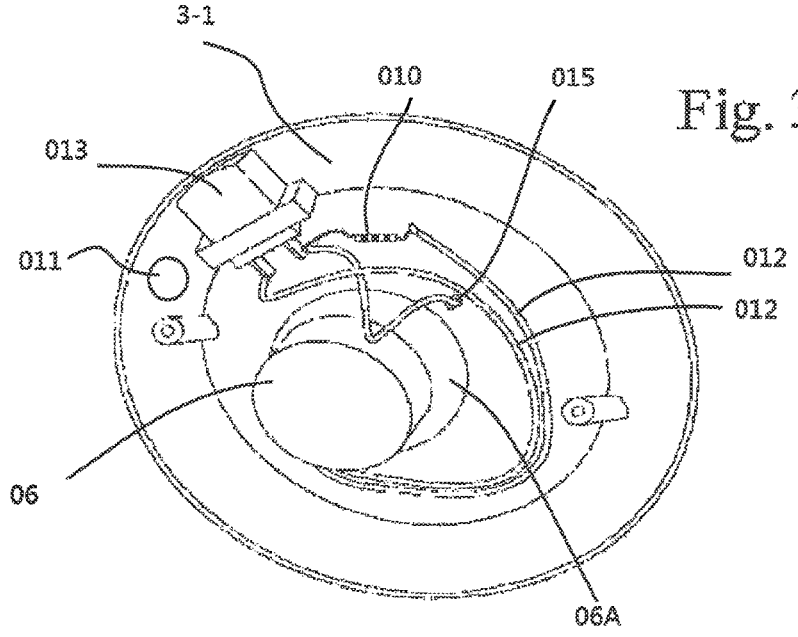

FIG. 1 shows an LED projection light (1) having more than one reflect and/or refraction piece (01), the LED projection light (1) being a plug-in type device having prong (02) to connect with a wall outlet, extension cord, power station, or desk lamp outlet receptacle. The LED projection light (1) can project the light image to a ceiling, walls, or floor using the more than one optics-lens (01) construction. The optics-piece (02) has more than one convex lens which has the inner surface has plurality of mirror-like polished reflector(s) and an exterior surface of which has a round convex shape to form a respective convex-lens. The plurality of reflective and/or refractive lens may be including in a hemispherical structure (01-T) that is combined with another hemispherical structure (01-L) to form ball shape. Light beams emitted by an LED hit the first reflect-section or area or parts, which reflects the light beams to the second, third, and/or fourth optics section or area or parts until the light beams pass through the convex-lens surfaces to the exterior of the ball shape cover or housing.

As shown in FIG. 2-5, a splendid color image or light-beams (03) (03') (03'') in all surrounding areas as shown the light traveling path form one of light-beam (A) emit and reflected to get (A1)(A2), and (A2) reflect again to get (A3) (A4), and refracted to have light-beam (B1) (B3) (B4). The LEDs (05) (05A) (05B) may have any desired color, specifications, size, functions and each LED (05) (05A) (05B) can have its own emitting direction, orientation, or angle in any direction to emit to the said inner surface or area or sections of the optics-piece(s) has more than one reflecting and/or refracting surfaces or areas or sections so that even though the light emitting angle may be narrow, after the light beam has been reflected and/or refracted, the light will come out all over the ball shape as a result of using (1) more than one LEDs (05) (05A) (05B), and/or (2) more than one reflecting and/or refracting optics-surfaces or areas or sections, and/or (3) more than one optics-lens (01) (01-T) (01-L) (01-inner), and/or (4) interchangeable power sources (03) (03A), including the parts and accessories (010) (011)(012)(013)(04)(055) those described in the inventor's U.S. patent application Ser. Nos. 12/318,471; 12/318,470; 12/834,435; 12/292,153 (now U.S. Pat. No. 7,871,192); Ser. No. 12/232,505 (now U.S. Pat. No. 7,832,917); Ser. No. 12/318,473 (now U.S. Pat. No. 7,832,918); Ser. No. 12/624,621 (now U.S. Pat. No. 8,303,150); Ser. No. 12/771,003 (now U.S. Pat. No. 8,408,736); Ser. No. 12/876,507 (now U.S. Pat. No. 8,083,377); Ser. No. 12/886,832; 12/938,564; 12/948,953; and Ser. No. 13/021,107.

FIG. 1-2, FIG. 2-4 shows an alternating current (AC) power unit which has an AC adaptor has circuit-outside housing as FIG. 1-2 (013B) FIG. 2-4 (013A), transformer has circuit outside of housing as FIG. 1-2 (013B) & FIG. 2-4 (013A), and AC wires has circuit inside LED projection light housing FIG. 1-2 (013C) to enable the LED projection light to have a splendid projection light image for different locations and applications.

FIGS. 2-2 and 2-5 show a direct current (DC) power unit which can have power from any direct current device such as batteries (04), energy storage including USB power-bank (FIG. 2-5), or solar power system, or wind power system, or chemical power system.

It will be appreciated that interchangeable AC and DC power sources may also be utilized as described in the inventor's U.S. Pat. No. 8,434,927.

FIGS. 1-2 and 2-4 show a plug-in type for LED device with a base (2) that installed AC plug-wire (03A) on the device housing to provide AC power to drive the LEDs by an inner (013C) or outside circuit (013A) (013B) that includes any of a (i) sensor (010), or (ii) switch (011), or (iii) control, (iv) optional motor (06) and gear-set (06A) to make the desired number of optics-lens to rotate; to project an image onto a ceiling, wall, or floor has plenty of color and motion (in case a motor (06) is provided).

The geometrically shaped optics-lens (01) has more than one reflection and/or refraction surfaces or areas or sections (cross lines) which, as shown in FIG. 2 and FIG. 4-1 and FIG. 4-2 may be in the form of a spherical optics-lens (01) having a plurality of flat mirror-polished interior and/or exterior having a round convex exterior surface that forms a convex-lens. Not only can reflect the light beams, but it also can allow light beam refract and transmission.

FIGS. 2-2 and 2-3 and FIG. 2-4, and FIG. 3 and FIG. 3-1 show an AC power LED projection light (01) having (I) a receptacle (015) to receive the transformer, adaptor plug (014); or (II) AC wires (03A) to connect with power to cause the LEDs to turn on and projection light to desired areas. Power can also be supplied by a USB wire (055) to get power from USB port of other products, as shown in FIG. 2-5.

FIG. 3: The projection LED light (3) has more than one reflective and/or refractive optic-lens to allow light to pass through the convex-lens, and reflect and/or refract within the LED projection light housing, thereby projecting an image to a ceiling, wall, or floor.

FIG. 3-1 shows the inner construction of a preferred the projection LED light (3) having built-in motor (06) fixed in the housing (3A) by screw (s) (09). A gear-set (06A) may be provided to reduce the motor's (06) and axis (07) to make desired number of optics-lens (01-T) (01-L) (01-inner) for rotating speed to a slower speed to prevent the image on the ceiling, wall, or floor from moving to rapidly, which would make people uncomfortable. Additional parts and accessories (010)(011)(012)(013)(014)(015) that may be provided include a switch (010) and conductive wires (012) including AC plug-wire to connect with circuit (013) and the power source.

FIG. 4: shows a projection light device which light beams reflect within more than one reflection-surface or areas or parts on an inner side of optics-lens in the shape of a sphere as FIG. 4). The light beams also refracted and pass through optic-lens which has an outside round surface to form convex-lens to project the image to the ceiling, wall, or floor. This embodiment (3-1) thus includes more than one reflection and/or refraction surface or section or areas in the optics-lens, and light projection though the more than one optics-lens (01-T) (01-L) (01-inner) (01-M), the inner side of which is a flat mirror-polished reflector and the outer side of which has a sphere-shape to form convex-lenses, the plurality of the said convex lenses together forming a semi-spherically shaped or more than half of a spherical structure.

From Fig (FIG. 4) The preferred LED projection light application is for outdoor light has the top optic-lens (01-T) cover is a diamond-cut treated optic-lens has LED light source (R2) emit light-beam (R3) to inner flat reflective-area to split into (R3') and reflected light beam (R3') to hit the inner other points or area or segments or parts, and the said reflected light-beam pass through the wall material and deviate basing on the refractive physical theory as light beam (R3") to become refracted light-beam (R3''') came out from the outside surface. The light beam from LED (R3)→reflected→(R3')→refracted→(R3")→refracted→(R3''') this is one of the LED light traveling-path for preferred embodiment which has lower optic-lens (01-L) and top optics-lens (01-L).

The LED light-beam (R3) reflected into not only have (R3') but also have the $2^{nd}$ reflected light-beam (R4)→Reflected→(R5)→refracted→(R5')→refracted→R5". Also, at the same time has the light-beam (R4) also not only reflected into (R5) but also have light-beam (R4')→refracted→(R4')→refracted→(R4")→refracted→(R4'''). The LED single light-beam can has plurality of light-beam been reflected and/or refracted within the lower and/or top optics-lens at same time and incorporate with motor (06) and/or gear-set (06') to make the preferred top or lower optics-lens to rotating will make more splendid lighted pattern or image for moving effects.

So the diamond-cut optic-lens (01-T) for outdoor light front cover to incorporated with inner $1^{st}$ optics-lens (01-L) (01-inner) is a prism-lens which has multiple triangle or teeth like reflectors with thicker thickness can also create splendid light performance. Furthermore, while change the LED color from 1 color to 2 color or more colors and IC control so can make the more assortments light performance outdoor lighting.

FIG. 4-1 shows two spheres optics-len(s) to form the optics-lens(s) assembly. Each one of the optic-lens has more than one reflection to form the more than half-sphere geometric shape ball. This arrangement may use concepts described in the inventor's earlier U.S. Pat. No. 7,632,004, which describes an LED night light base with more than one optics lens, U.S. Pat. No. 8,277,087, which describes an arrangement having more than one reflect lens; U.S. Pat. No. 7,455,444, which describes an LED night light having more than one LED; and U.S. Pat. No. 8,434,927, which describes interchange power sources.

From FIG. 4-1 show how to make the diamond-cut construction or other treatment for optic-lens (01-T) or optic-cover more than ½ ball. The top optic-lens (01-T) cover has one ½ half ball (R9) for top and add or assembled with lower partial of ball preferred optics-treatment optics-lens (01-L) so can make the top cover or top optics-lens (01) has more than ½ ball size. The reason to make more than ½ ball because we need to make much bigger size and more eye-exciting lighted image and/or pattern. The distance from the top cover or top optics-lens (01-T) to the lower (01-L) or inner $1^{st}$ optic-lens has related the best distance which is more than ½ ball because more distance can created more spread-out and more clear image and/or lighted patterns.

From FIG. 4-2) show the top (01-T) or lower (01-L) or inner (01-M) construction of the optic-lens which is diamond-cut optic-lens. The inner surface have a lot of flat surface (R12) which has high polished treated so can easily reflect all input light-beam and reflect to other direction depend on the input-angle of light-beam from LED(s). The one of diamond-cut optic-lens is the preferred for top (01-T) and/or lower (01-L) sphere $2^{nd}$ optic-lens outside is ball type so the outside is round and inner is flat surface so it become the convex lens (R13) so the $2^{nd}$ optic-lens for diamond-cut which also has plurality of the tiny convex-lens which offer the refractive optic-properties. This embodiment clear explain the diamond-cut $2^{nd}$ Top (01-T) optics-lens has both refractive and/or reflective optics properties in one top cover or top-lens to make the lower (01-L) or inner $1^{st}$ optic-lens came out light-beam to make more refraction and-or reflection to get splendid light effects.

In the preferred embodiments, images are created based on the relationship between the first and the second reflective and/or refractive lens or all other optics-lens. The light device can employ any kind of design, shape, display, or geometric shape, arrangement of the said LED projection light.

Although specific preferred embodiments of the current invention are described above, it is to be appreciated that all alternative, equivalent, same-function and/or same-skill-or-theory variations, modifications, replacements, arrangements, or constructions may still fall within the current scope of the invention.

The invention claimed is:

1. A projection LED light, comprising:

at least one LED;

at least one rotating or moving optics piece having reflective areas that cause light beams from the LED to be reflected multiple times, and refractive areas through which the light beams pass as they exit the optics piece after being reflected multiple times to create and project images or lighted patterns to outdoor locations or surfaces external to said LED light when an AC prong or AC wire's male plug of the LED light is plugged into a wall outlet or outlet of an extension cord to connect with an AC power source, wherein said optics piece allows narrow light beams from the LED to (a) pass through and spread to wider areas, (b) be reflected to form a plurality of images or lighted patterns, and (c) be refracted to enlarge or change a direction of one of the images or lighted patterns created by the reflective and refractive surfaces, wherein the outdoor locations or surfaces external to said LED light include surfaces selected from a ceiling, wall, house, fence, or other outdoor location, wherein said at least one LED is connected to the AC power source by conductors and circuitry for causing said at least one LED to turn on and off for a predetermined period of time to provide predetermined functions, colors, and effects, and wherein the at least one rotating or moving optics piece having said reflective and refractive areas is an inner optics lens or a top cover having a dome shape or an at least ½ ball shape and wherein light beams transmitted through the optics piece spread out to the outdoor locations to obtain a wider viewing angle, and wherein the LED light further includes at least one of a motor, gear set, movement, and rotating device to cause rotation of the at least one LED or the optics piece and thereby provide the image or lighted patterns with pattern-changing or motion effects.

2. A projection LED light as recited in claim 1, wherein said at least one rotating or moving optics piece includes at least one said inner optics lens, at least one said top cover, or at least one said inner optics lens and at least one said top cover.

3. A projection LED light as recited in claim 1, wherein said optics piece is a transparent, partially transparent, or colored transparent piece.

4. A projection LED light as recited in claim 1, wherein said power source is selected from the group consisting of an AC outlet, DC batteries, a solar power storage device, a chemical power source, and a wind power source, to provide electricity to drive said at least one LED to emit light beams.

5. A projection LED light as recited in claim 1, further comprising a motor and gear set that fit within the LED light to provide rotating or moving image and lighted patterns with desired projection functions, effects, performance.

6. A projection LED light as recited in claim 1, wherein said at least one LED is selected from a single or multiple color LED, a multiple piece LED, a standard LED, and a custom LED assembly.

7. A projection LED light as recited in claim 1, wherein said male plug or AC prong is arranged to be powered by or plugged into a wall outlet or power receptacle, or connected with a cigarette lighter.

8. A projection LED light as recited in claim 1, wherein said optics piece is constructed or assembled from one or more of a light-transmitting lens, reflective lens, convex lens, concave lens, laser lens, holographic lens.

9. A projection LED light, comprising:

at least one LED;

at least one rotating optics piece having at least one reflective section that causes light beams from the LED to be reflected multiple times, and at least one refractive section through which the light beams pass as they exit the optics piece after being reflected multiple times, wherein said optics piece is a top cover or inner lens of the LED light and the optics piece (a) transmits a moving image lighted pattern over a widened area in front of the LED light, (b) reflects light beams to form a plurality of moving images or light spots, and (c) refracts the light beams to enlarge or change a direction of the moving image or a lighted pattern, the LED light projecting the image, light beams, light spots, or lighted pattern to a location external to said LED light, including a ceiling, wall, housing, fence, or other indoor or outdoor location, wherein the at least one LED is selected from any combination of a single color, multiple color, multiple piece single color, standard, and special LED assembly, wherein said at least one LED is connected to a power source by conductors and circuitry for causing said at least one LED to turn on and off for a predetermined time period, duty cycle, or duration to provide predetermined functions, colors, and effects, wherein a light beam emitted by the at least one LED is reflected by the at least reflective section of said optics piece and then is transmitted through the rotating optics piece by passing through and being refracted by the at least one said refractive section to create or project the moving image, light beams, light spots, or lighted patterns to said outdoor locations or surfaces external to said LED light, wherein the LED light further includes parts selected from a movement, a motor, a rotating device, and a gear set fitted into the LED light to exhibit at least one of moving, pattern-changing, color-changing, and image-changing effects, and wherein the LED light is connected to an AC power source by an AC wire with a male plug or by built-in prongs arranged to be plugged into an outlet.

10. A projection LED light as claimed in claim 1, wherein the optical piece, which has a dome shape, an at least ½ ball shape, or a spherical shape optics piece, is made up of sections with a flat reflective surface on the inside to form said reflective surfaces, and a convex lens surface on the outside to form said refractive surfaces.

11. A projection LED light as claimed in claim 9, wherein the optical piece, which has a dome shape, an at least ½ ball shape, or a spherical shape optics piece, is made up of sections with a flat reflective surface on the inside to form said reflective surfaces, and a convex lens surface on the outside to form said refractive surfaces.

* * * * *